United States Patent [19]

Minegishi et al.

[11] Patent Number: 5,021,286

[45] Date of Patent: Jun. 4, 1991

[54] CUSHION MATERIAL AND METHOD OF MANUFACTURING THE SAME

[75] Inventors: Takeshi Minegishi; Kiyotugu Takabatake; Kunio Asobe, all of Yokohama, Japan

[73] Assignee: NHK Spring Co., Ltd., Yokohama, Japan

[21] Appl. No.: 562,204

[22] Filed: Aug. 3, 1990

[30] Foreign Application Priority Data

| | | | |
|---|---|---|---|
| Aug. 10, 1989 | [JP] | Japan | 1-207739 |
| Aug. 10, 1989 | [JP] | Japan | 1-207741 |
| Oct. 13, 1989 | [JP] | Japan | 1-265002 |

[51] Int. Cl.[5] ..... B32B 27/14

[52] U.S. Cl. ..... 428/198; 5/448; 156/290; 428/288; 428/297

[58] Field of Search ..... 5/448; 428/198, 288, 428/297; 156/290

[56] References Cited

U.S. PATENT DOCUMENTS

| | | | |
|---|---|---|---|
| 4,515,854 | 5/1985 | Kogame et al. | 428/288 |
| 4,902,542 | 2/1990 | Minegishi et al. | 428/288 |
| 4,944,992 | 7/1990 | Yoneshige et al. | 428/212 |

*Primary Examiner*—James J. Bell

*Attorney, Agent, or Firm*—Frishauf, Holtz, Goodman & Woodward

[57] ABSTRACT

A cushion is obtained by impregnating an aqueous polyurethane polymer emulsion in three-dimensionally interwined fibers, removing an excessive aqueous polyurethane polymer emulsion and hardening the resultant material with heat. The surface of each fiber is covered with a polyurethane resin, and the fibers are bonded by the polyurethane resin at intersected portions of the fibers.

17 Claims, 1 Drawing Sheet

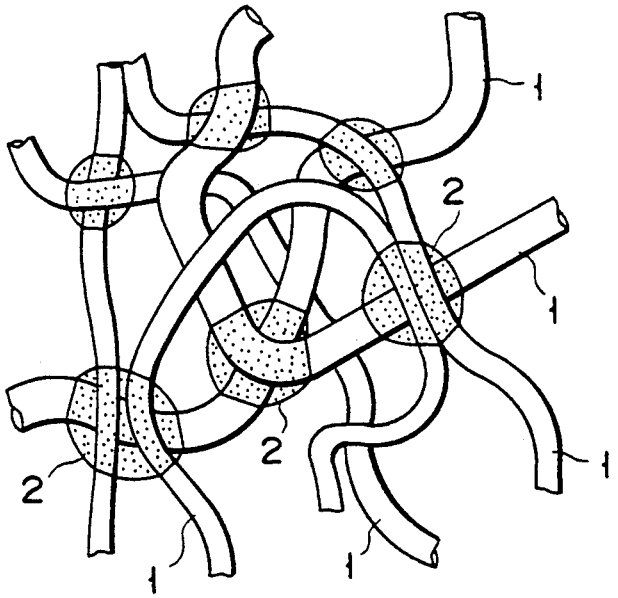
1
2
1
2
2
1
1
1

CUSHION MATERIAL AND METHOD OF MANUFACTURING THE SAME

BACKGROUND OF THE INVENTION

1. Field of the Invention

The present invention relates to a fiber-based cushion which can be used in, e.g., vehicles, furniture, and bedclothes and a method of manufacturing the same.

2. Description of the Related Art

Various types of materials are conventionally used as a cushion of a sheet of a vehicle and the like. Examples of the material are a palm rock using fibers of a palm, a synthetic resin foam such as a polyurethane foam, and cotton consisting of organic synthetic fibers. However, the palm rock is easily flattened because it has a large specific gravity and has a problem in source supply stability, and the polyurethane foam easily becomes stuffy because its air permeability is poor and is uncomfortable to sit in. The organic synthetic fiber cotton has a low hardness and is therefore easily flattened.

In recent years, therefore, a cushion material obtained by bonding crossing portions of three-dimensionally interwined organic synthetic fibers by a polyurethane resin has been developed and proposed in Published Unexamined Patent Application No. 61-158437. This cushion material has excellent air permeability, is not easily flattened, has high durability, and is light in weight.

In order to manufacture the cushion material obtained by bonding crossing portions of three-dimensionally interwined organic synthetic fibers by a polyurethane resin, the organic synthetic fibers are impregnated with a polyurethane prepolymer, and this polyurethane prepolymer is hardened. In this case, however, since the polyurethane prepolymer cannot be impregnated in the organic synthetic fibers because its viscosity is very high, it is diluted to adjust the viscosity.

1,1,1-trichloroethane or the like, however, which is used as an organic solvent has strong toxicity, it cannot be directly disposed in consideration of environmental conditions. Therefore, a large-scale salvage installation or the like is required. In addition, since hardening of the polyurethane prepolymer requires water vapor, an expensive installation such as a boiler is required.

SUMMARY OF THE INVENTION

It is an object of the present invention to provide a cushion which has excellent air permeability, is not easily flattened, has high durability, is light in weight, and has a high stuffiness resistance.

It is another object of the present invention to provide a method of manufacturing a cushion which has excellent air permeability, is not easily flattened, has a high durability, is light in weight, and can be manufactured with high workability without using an organic solvent.

According to the present invention, there is provided a cushion obtained by impregnating three-dimensionally interwined fibers with an aqueous polyurethane polymer emulsion and hardening the resultant material with heat, wherein the surface of each fiber is covered with a polyurethane resin, and the fibers are bonded by the polyurethane resin at intersected portions of the fibers.

In addition, according to the present invention, there is provided a method of manufacturing a cushion, comprising the steps of:

impregnating an aqueous polyurethane polymer emulsion in three-dimensionally interwined fibers;

removing an excessive aqueous polyurethane polymer emulsion; and hardening the aqueous polyurethane polymer emulsion impregnated in the fibers with heat.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawing, which is incorporated in and constitutes a part of the specification, illustrates presently preferred embodiments of the invention and, together with the general description given above and the detailed description of the preferred embodiments given below, serves to explain the principles of the invention.

Figure is a view showing a cushion according to one embodiment of the present invention.

DETAILED DESCRIPTION OF THE PREFERRED EMBODIMENTS

Preferred embodiments of the present invention will be described in detail below.

A figure shows a cushion according to a preferred embodiment of the present invention. In this figure, the cushion consists of three-dimensionally interwined fibers 1. The surfaces of the fibers 1 are covered with a polyurethane resin 2, and the fibers 1 are interwined with each other at interwined portions by the polyurethane resin 2.

Cottons of various types of organic synthetic fibers can be used as the three-dimensionally interwined fibers. Examples of the organic synthetic fiber are a polyester fiber, a nylon fiber, and an acryl fiber. These fibers can contain an inorganic fiber such as a metal fiber or a glass fiber.

The thickness of the fiber is preferably 1 to 50 denier.

A water-absorptive fiber is preferably used as the three-dimensionally interwined fiber. Examples of the water-absorptive fiber are cottons of various types of organic synthetic fibers subjected to a hydrophilic treatment by using, e.g., polyalkylene glycol, metal isophthalate, or copolymer polyethylene terephthalate. When the water-absorptive fiber is used, a stuffiness resistance is improved, and various physical properties can be improved.

A method of manufacturing the cushion of the present invention is performed in accordance with the following steps.

Firstly, three-dimensionally interwined fibers are impregnated with an aqueous polyurethane polymer emulsion.

An aqueous polyurethane prepolymer can be used as the aqueous polyurethane polymer. The aqueous polyurethane prepolymer is prepared by reacting an isocyanate compound with polyol obtained by addition-polymerizing a mixture of alkylene oxides such as ethylene oxide and propylene oxide with glycerin. This aqueous polyurethane prepolymer may contain a hardening agent as needed. Examples of the hardening agent are an epoxy resin and a melamine resin. The concentration of an emulsion of the prepolymer is preferably 25% to 40%.

A prepolymer containing a blocked isocyanate group can be used as the aqueous polyurethane prepolymer. This polyurethane prepolymer is prepared by blocking an isocyanate group of a prepolymer by a blocking agent such as an oxime, a malonate, and a phenol. The prepolymer is obtained by reacting an isocyanate compound with polyol obtained by addition-polymerizing a mixture of ethylene oxide and propylene oxide with glycerin.

A prepolymer having a nonionic and/or ionic hydrophilic site can be used as the aqueous polyurethane prepolymer. Examples of the nonionic hydrophilic site, the anionic hydrophilic site, and the cationic hydrophilic site are an EO chain, a COO—group and an $SO^{3-}$group, and $NR^{3+}$, respectively.

Subsequently, an excessive aqueous polyurethane prepolymer emulsion is removed. Removal of the excessive emulsion can be performed by using a centrifugal separator or a mangle so that a weight ratio of the fibers to the emulsion is 8 : 2 to 6 : 4.

Lastly, the aqueous polyurethane prepolymer emulsion impregnated in the fibers is hardened with heat. A heating temperature for hardening is preferably 100° C. to 150° C.

As described above, in the method of the present invention, the aqueous polyurethane is used as a binder for bonding the fibers at their intersected portions. Since the polyurethane is hydrophilic, its concentration can be arbitrarily adjusted by using water without using an organic solvent. Therefore, an emulsion having a desired concentration can be easily impregnated in the three-dimensionally interwined fibers.

In addition, a hardening agent can be added to the aqueous polyurethane as needed so that the aqueous polyurethane prepolymer is easily hardened upon heating up to the above heating temperature.

The present invention will be described in more detail below by way of its examples and comparative examples.

EXAMPLE 1

Polyetherpolyol (molecular weight : 3,000, functionality : 2) and TDI (tolylene diisocyanate) were reacted at 80° C. for four hours, and an epoxy resin was added as a hardening agent to the resultant material to obtain an aqueous polyurethane prepolymer. The obtained aqueous polyurethane prepolymer was put into water under stirring to prepare an emulsion having a nonvolatile content of 30% and viscosity of 50 c.p. (20° C.). An excessive amount of the prepared emulsion was impregnated in polyester cotton (HYBAL 6d, available from TEIJIN LTD.), and the emulsion was removed from the resultant material by a centrifugal force until a predetermined amount of the emulsion remained. The resultant material was filled in a perforated metal mold to obtain a predetermined density. At this time, a weight ratio of the polyester cotton to the prepolymer emulsion was adjusted to be 7 : 3.

A hot air at 120° C. to 130° C. was flowed to harden the polyester cotton filled in the mold for four minutes, and the hardened polyester cotton was released from the mold to obtain a cushion sample.

EXAMPLE 2

An excessive amount of an emulsion prepared following the same procedures as in Example 1 except that a melamine-based resin was used as a hardening agent was impregnated in polyester cotton (HYBAL 20d, available from TEIJIN LTD.), and the emulsion was removed from the resultant material by a centrifugal force until a predetermined amount of the emulsion remained. The resultant material was filled in a perforated metal mold to obtain a predetermined density. At this time, a weight ratio of the polyester cotton and the prepolymer emulsion was adjusted to be 7 : 3.

A hot air at 120° C. to 130° C. was flowed to harden the polyester cotton filled in the mold for four minutes, and the hardened polyester cotton was released from the mold to obtain a cushion sample.

EXAMPLE 3

An excessive amount of an emulsion prepared following the same procedures as in Example 1 was impregnated in polyester cotton (HYBALs 6d & 40d [1 : 1 mixture]), and the emulsion was removed from the resultant material by a centrifugal force until a predetermined amount of the emulsion remained. The resultant material was filled in a perforated metal mold to obtain a predetermined density. At this time, a weight ratio of the polyester cotton to the prepolymer emulsion was adjusted to be 7 : 3.

A hot air at 120° C. to 130° C. was flowed to harden the polyester cotton filled in the mold for four minutes, and the hardened polyester cotton was released from the mold to obtain a cushion sample.

EXAMPLE 4

An excessive amount of an emulsion prepared following the same procedures as in Example 1 except that a melamine-based resin was used as a hardening agent was impregnated in polyester cotton (HYBAL 20d, available from TEIJIN LTD.), and the emulsion was removed from the resultant material by using a mangle (5 to 6 kgf/cm$^2$) until a predetermined amount of the emulsion remained. The resultant material was filled in a perforated metal mold to obtain a predetermined density. At this time, a weight ratio of the polyester cotton to the prepolymer emulsion was adjusted to be 7 : 3.

A hot air at 120° C. to 130° C. was flowed to harden the polyester cotton filled in the mold for four minutes, and the hardened polyester cotton was released from the mold to obtain a cushion sample. Control 55 parts by weight of 1,1,1-trichloroethane was added to 45 parts by weight of a polyurethane prepolymer (AX-710, available from Mitsui Toatsu chemicals, Inc., —NCO : 5.0%), and the viscosity of this solution was adjusted to be 70 c.p. An excessive amount of the resultant solution was impregnated in polyester cotton (HYBAL 6d, available from TEIJIN LTD.), and the solution was removed from the resultant material by a centrifugal force until a predetermined amount of the polyurethane prepolymer solution remained. The resultant material was filled in a perforated metal mold to obtain a predetermined density. At this time, a weight ratio of the polyester cotton to the prepolymer solution was adjusted to be 7 : 3.

The polyurethane prepolymer in the polyester cotton filled in the form was hardened by a —NCO equivalent amount or more of water vapor at 100° C. for four minutes, and the hardened polyester cotton was released from the mold to obtain a cushion sample.

When various characteristics of the five types of cushion samples obtained by Examples 1 to 4 and Control were tested, the results listed in the following Table 1 were obtained.

TABLE 1

| | Example 1 | Example 2 | Example 3 | Example 4 | Control |
|---|---|---|---|---|---|
| Density (kg/m$^2$) | 30 | 30 | 30 | 30 | 30 |
| Hardness (kgf/314 cm$^2$) | 20 | 19 | 18 | 20 | 20 |
| Ball Drop Resilience (%) | 65 | 65 | 65 | 65 | 60 |
| Repeated Compression Permanent Strain (%) | 4 | 4 | 4 | 4 | 4 |
| 70° C. Thermal Compression Strain (%) | 15 | 15 | 15 | 15 | 15 |
| 50° C - 95% Humidity Thermal Compression Strain (%) | 17 | 17 | 17 | 17 | 17 |
| Air Permeability (cm/sec) | 250 | 350 | 300 | 250 | 250 |
| Bonded Portion Peel Strength (gf) | 100 | 100 | 100 | 100 | |
| Tensile Strength (kgf) | 2.0 | 1.8 | 2.0 | 1.5 | 2.0 |
| Water Absorption (%) | 2.0 | 2.0 | 2.0 | 2.0 | 1.0 |

As shown in Table 1, the cushions of the present invention (Examples 1 to 4) have substantially the same characteristics as those of the conventional cushion material using a polyurethane prepolymer having viscosity adjusted by an organic solvent (Control) in density, hardness, repeated compression strain, 70° C.-thermal compression strain, air permeability, bonded portion peel strength, and tensile strength, and have characteristics superior thereto in ball drop resilience, 50° C.-95% humidity thermal compression strain, and water absorption.

EXAMPLE 5

Polyetherpolyol (molecular weight : 3,000, functionality : 3) and TDI (tolylene diisocyanate) were reacted at 80° C. for four hours, and methylethylketoneoxime (1.0 equivalent amount) was added to the resultant material to cause a reaction at 40° C. for two hours to obtain a blocked aqueous polyurethane prepolymer (dissociation temperature=110° C. or more). The obtained blocked aqueous polyurethane prepolymer was put into water under stirring to prepare an emulsion having a nonvolatile content of 30% and viscosity of 120 c.p. (20° C.). An excessive amount of the prepared emulsion was impregnated in polyester cotton (Hydrophilic Cotton 6d, available from TEIJIN LTD.), and the emulsion was removed from the resultant material by a centrifugal force until a predetermined amount of the emulsion remained. The resultant material was filled in a perforated metal mold to obtain a predetermined density. At this time, a weight ratio of the polyester cotton to the prepolymer emulsion was adjusted to be 7 : 3.

A hot air at 120° C. to 130° C. was flowed to harden the polyester cotton filled in the mold for four minutes, and the hardened polyester cotton was released from the mold to obtain a cushion sample.

EXAMPLE 6

Polyetherpolyol (molecular weight : 1,000, functionality : 2) and TDI (tolylene diisocyanate) were reacted at 80° C. for four hours, and an epoxy-based resin was added as a hardening agent to the resultant material to obtain an aqueous polyurethane prepolymer. The obtained aqueous polyurethane prepolymer was put into water under stirring to prepare an emulsion having a nonvolatile content of 30% and viscosity of 50 c.p. (20° C.). An excessive amount of the prepared emulsion was impregnated in polyester cotton (Hydrophilic Cotton 6d, available from TEIJIN LTD.), and the emulsion was removed from the resultant material by a centrifugal force until a predetermined amount of the emulsion remained. The resultant material was filled in a perforated metal mold to obtain a predetermined density. At this time, a weight ratio of the polyester cotton to the prepolymer emulsion was adjusted to be 7 : 3.

A hot air at 120° C. to 130° C. was flowed to harden the polyester cotton filled in the mold for four minutes, and the hardened polyester cotton was released from the mold to obtain a cushion sample.

EXAMPLE 7

An excessive amount of an emulsion prepared following the same procedures as in Example 5 was impregnated in polyester cotton (Hydrophilic Cotton 6d, available from TEIJIN LTD.), and the emulsion was removed from the resultant material by using a mangle (5 to 6 kgf/cm$^2$) until a predetermined amount of the emulsion remained. The resultant material was filled in a perforated metal mold to obtain a predetermined density. At this time, a weight ratio of the polyester cotton to the prepolymer emulsion was adjusted to be 7 : 3.

A hot air at 120° C. to 130° C. was flowed to harden the polyester cotton filled in the mold for four minutes, and the hardened polyester cotton was released from the mold to obtain a cushion sample.

EXAMPLE 8

Polyetherpolyol (molecular weight : 3,000, functionality : 3) and TDI (tolylene diisocyanate) were reacted at 80° C. for four hours, and methylethylketoneoxime (1.0 equivalent amount) was added to the resultant material to cause a reaction at 40° C. for two hours to obtain a blocked aqueous polyurethane prepolymer (dissociation temperature=110° C. or more). The obtained blocked aqueous polyurethane prepolymer was put into water under stirring to prepare an emulsion having a nonvolatile content of 30.5% and viscosity of 120 c.p. (20° C.). An excessive amount of the prepared emulsion was impregnated in polyester cotton (HYBAL 6d, available from TEIJIN LTD.), and the emulsion was removed from the resultant material by a centrifugal force until a predetermined amount of the emulsion remained. The resultant material was filled in a perforated metal mold to obtain a predetermined density. At this time, a weight ratio of the polyester cotton to the prepolymer emulsion was adjusted to be 7 : 3.

A hot air at 120° C. to 130° C. was flowed to harden the polyester cotton filled in the mold for four minutes, and the hardened polyester cotton was released from the mold to obtain a cushion sample.

When various characteristics of the five types of cushion samples obtained by Examples 5 to 8 were tested, the results listed in the following Table 2 were obtained.

TABLE 2

| | Example 5 | Example 6 | Example 7 | Example 8 |
|---|---|---|---|---|
| Density (kg/m$^2$) | 30 | 30 | 30 | 30 |
| Hardness (kgf/314 cm$^2$) | 20 | 19 | 18 | 20 |
| Ball Drop Resilience (%) | 65 | 65 | 65 | 60 |
| Repeated Compression Permanent Strain (%) | 4 | 4 | 4 | 4 |
| 70° C. Thermal Compression Strain (%) | 12 | 13 | 12 | 15 |
| 50° C. - 95% Humidity Thermal Compression Strain (%) | 15 | 16 | 15 | 20 |
| Air Permeability (cm/sec) | 250 or more | 250 or more | 250 or more | 250 or more |
| Hardening Time | 4 min. | 4 min. | 4 min. | 4 min. |
| Bonded Portion Peel Strength (gf) | 150 | 100 | 150 | 100 |
| Tensile Strength (kgf) | 2.0 | 2.0 | 2.0 | 2.0 |
| Water Absorption (%) | 2.0 | 2.0 | 2.0 | 1.0 |

As shown in Table 2, the cushion samples of the present invention (Examples 5 to 7) have substantially the same characteristics as those of the cushion sample not using a water-absorptive fiber (Example 8) in density, hardness, ball drop resilience, and repeated compression strain, and have characteristics superior thereto in bonded portion peel strength, tensile strength, and water absorption.

EXAMPLE 9

Polyetherpolyol having a molecular weight of 3,000, an average functionality of 3, and a ratio of propylene oxide/ethylene oxide=50/50 (wt %) was sufficiently dehydrated, and tolylene diisocyanate was supplied to dehydrated polyetherpolyol to cause a reaction at 80° C. for four hours so that an isocyanate index was 200, thereby preparing a viscous isocyanate terminal prepolymer. Methylethylketooxime was added to the obtained prepolymer to complete a blocking reaction at 40° C. for two hours, and the resultant material was put into water under strong stirring, thereby preparing a semiopaque aqueous dispersion composition. An excessive amount of the prepared aqueous dispersion composition was impregnated in polyester cotton (HYBAL 6d, available from TEIJIN LTD.). A predetermined amount of the composition was removed from the resultant material by a centrifugal force, and the resultant material was filled in a perforated metal mold to obtain a predetermined density. At this time, a weight ratio of the cotton to the polyurethane was adjusted to be 6.5 : 3.5. A hot air at 120° C. to 130° C. was flowed to harden the cotton filled in the mold for four minutes, and the hardened cotton was released from the mold to obtain a cushion sample.

EXAMPLE 10

Polybutylene adipate having a molecular weight of 2,000 and an average funcionality of 2 was sufficiently dehydrated, and dimethylol propionic acid was added to dehydrated polybutylene adipate. In addition, tolylene diisocyanate was supplied to the resultant material to cause a reaction at 80° C. for four hours so that an isocyanate index was 150, thereby preparing a viscous isocyanate terminated prepolymer. Methylethylketooxime was added to the obtained prepolymer to complete a blocking reaction at 40° C. for two hours, and the resultant material was put into water containing triethylamine under strong stirring, thereby preparing a semiopaque aqueous dispersion composition. An excessive amount of the prepared aqueous dispersion composition was impregnated in polyester cotton (HYBALs 6d & 40d [1 : 1] Cotton Mixture, available from TEIJIN LTD.). A predetermined amount of the composition was removed from the resultant material by a centrifugal force, and the resultant material was filled in a perforated metal mold to obtain a predetermined density. At this time, a weight ratio of the cotton to the polyurethane was adjusted to be 6.5 : 3.5. A hot air at 120° C. to 130° C. was flowed to harden the cotton filled in the mold for four minutes, and the hardened cotton was released from the mold to obtain a cushion sample.

EXAMPLE 11

Polyetherpolyol having a molecular weight of 1,000, an average funcionality of 2, and a ratio of propylene oxide/ethylene oxide=80/20 (wt %) was sufficiently dehydrated, and dimethylol propionic acid was added to dehydrated polyetherpolyol. In addition, tolylene diisocyanate was supplied to the resultant material to cause a reaction at 80° C. for four hours so that an isocyanate index was 200, thereby preparing a viscous isocyanate terminal prepolymer. Methylethylketooxime was added to the obtained prepolymer to complete a blocking reaction at 40° C. for two hours, and the resultant material was put into water containing trimethylamine under strong stirring, thereby preparing a semiopaque aqueous dispersion composition. An excessive amount of the prepared aqueous dispersion composition was impregnated in polyester cotton (HYBAL 20d, available from TEIJIN LTD.) A predetermined amount of the composition was removed from the resultant material by a centrifugal force, and the resultant material was filled in a perforated metal mold to obtain a predetermined density. At this time, a weight ratio of the cotton to the polyurethane was adjusted to be 6.5 : 3.5. A hot air at 120° C. to 130° C. was flowed to harden the cotton filled in the mold for four minutes, and the hardened cotton was released from the mold to obtain a cushion sample.

EXAMPLE 12

Polyetherpolyol having a molecular weight of 3,000, an average functionality of 3, and a ratio of propylene oxide/ethylene oxide=50/50 (wt %) was sufficiently dehydrated, and tolylene diisocyanate was supplied to dehydrated polyetherpolyol to cause a reaction at 80° C. for four hours so that an isocyanate index was 200, thereby preparing a viscous isocyanate terminal prepolymer. Methylethylketooxime was added to the obtained prepolymer to complete a blocking reaction at 40° C. for two hours, and the resultant material was put into water under strong stirring, thereby preparing a semiopaque aqueous dispersion composition. An excessive amount of the prepared aqueous dispersion composition was impregnated in polyester cotton (HYBAL 6d, available from TEIJIN LTD.). A predetermined amount of the composition was removed from the resultant material by using a mangle [2 kgf/cm$^3$], and the resultant material was filled in a perforated metal mold to obtain a predetermined density. At this time, a weight ratio of the cotton to the polyurethane was adjusted to be 6.5 : 3.5. A hot air at 120° C. to 130° C. was flowed to harden the cotton filled in the mold for four minutes, and the hardened cotton was released from the mold to obtain a cushion sample.

When various characteristics of the five types of cushion samples obtained by Examples 9 to 12 and Control 1 were tested, the results listed in the following Table 3 were obtained.

TABLE 3

| | Example 9 | Example 10 | Example 11 | Example 12 | Control |
|---|---|---|---|---|---|
| Density (kg/m$^3$) | 30 | 30 | 30 | 30 | 30 |
| Hardness (kgf/314 cm$^2$) | 20 | 19 | 19 | 18 | 20 |
| Ball Drop Resilience (%) | 65 | 65 | 65 | 65 | 60 |
| Repeated Compression Permanent Strain (%) | 4 | 4 | 4 | 4 | 4 |
| 70° C. Thermal Compression Strain (%) | 15 | 15 | 15 | 15 | 15 |
| 50° C. - 95% Humidity Thermal Compression Strain (%) | 17 | 17 | 17 | 17 | 20 |
| Air Permeability (cm/sec) | 250 | 300 | 350 | 250 | 250 |
| Bonded Portion Peel Strength (gf) | 150 | 120 | 120 | 150 | 100 |

As is apparent from Table 3, the cushion samples of the present invention (Examples 9 to 12) have substantially the same characteristics as those of the conventional cushion sample using a polyurethane prepolymer having viscosity adjusted by an organic solvent (Control) in density, hardness, repeated compression strain, 70° C.-thermal compression strain, and air permeability, and have characteristics superior thereto in 50° C.-95% humidity thermal compression strain and bonded portion peel strength.

As has been described above, since aqueous polyurethane is used in the present invention, viscous adjustment can be performed by using water. Therefore, since a toxic organic solvent need not be used unlike in conventional methods, environmental conditions and workability can be improved. In addition, when a hardening agent is added to polyurethane, the polyurethane can be easily hardened at a predetermined heating temperature.

When a blocked aqueous polyurethane prepolymer is used, it can be incorporated in water while cross-linkability of —NCO is maintained. Therefore, this prepolymer can be stably treated as an emulsion. A desired hardening temperature can be selected by arbitrarily selecting a blocking agent. In this manner, since crosslinkability is held even in the presence of water, high peel strength can be maintained in a fiber bonded portion even after water is removed.

In addition, since a blocking agent is used, various types of crosslinking agents can be incorporated in a single solution. Therefore, a degree of freedom in selection of properties as a binder resin is increased. Furthermore, no water vapor is used in hardening, the scale of installation can be reduced.

When an water-absorptive fiber is used, not only a stuffiness resistance and a thermal compression property are improved, but also tensile strength is improved.

As described above, according to the present invention, there is provided an excellent cushion material which can be used in vehicles, furniture, bedclothes, and the like.

Additional advantages and modifications will readily occur to those skilled in the art. Therefore, the invention in its broader aspects is not limited to the specific details, representative devices, and illustrated examples shown and described. Accordingly, various modifications may be made without departing from the spirit or scope of the general inventive concept as defined by the appended claims and their equivalents.

What is claimed is:

1. A cushion obtained by impregnating an aqueous emulsion of hydrophilic polyurethane in three-dimensionally interwined fibers and hardening the resultant material with heat, wherein the surface of said fibers is covered with a hydrophilic polyurethane resin, and said fibers are bonded by said hydrophilic polyurethane resin at intersected portions of said fibers.

2. A cushion according to claim 1, wherein said fiber is an organic synthetic fiber.

3. A cushion according to claim 2, wherein said organic synthetic fiber is selected from the group consisting of a polyester fiber, a nylon fiber, and an acryl fiber.

4. A cushion according to claim 1, wherein the thickness of said fiber is 1 to 50 denier.

5. A cushion according to claim 1, wherein said fiber is a water-absorptive fiber.

6. A cushion according to claim 5, wherein said water-absorptive fiber is an organic synthetic fiber subjected to a hydrophilic treatment by using a compound selected from the group consisting of polyalkylene glycol, metal isophthalate, and copolymerized polyethylene phthalate.

7. A cushion according to claim 1, wherein said aqueous polyurethane emulsion is an aqueous polyurethane prepolymer.

8. A cushion according to claim 1, wherein said aqueous polyurethane emulsion is a blocked aqueous polyurethane prepolymer emulsion.

9. A cushion according to claim 1, wherein said aqueous polyurethane emulsion contains a blocked isocyanate group and has anionic and/or cationic hydrophilic site.

10. A method of manufacturing a cushion, comprising the steps of:

impregnating an aqueous emulsion of hydrophilic polyurethane in three-dimensionally interwined fibers;

removing an excessive aqueous polyurethane emulsion; and hardening said aqueous emulsion of hydrophilic polyurethane impregnated in said fibers with heat so as to bond said fibers by a hydrophilic polyurethane resin at intersected portions of said fibers.

11. A method according to claim 10, wherein said fiber is an organic synthetic fiber.

12. A method according to claim 11, wherein said organic synthetic fiber is selected from the group consisting of a polyester fiber, a nylon fiber, and an acryl fiber.

13. A method according to claim 10, wherein said fiber is a water-absorptive fiber.

14. A method according to claim 13, wherein said water-absorptive fiber is an organic fiber subjected to a hydrophilic treatment by using a compound selected from the group consisting of polyalkylene glycol, metal isophthalate, and copolymer polyethylene terephthalate.

15. A method according to claim 10, wherein said aqueous polyurethane emulsion is an aqueous polyurethane prepolymer.

16. A method according to claim 10, wherein said aqueous polyurethane emulsion is a blocked aqueous polyurethane prepolymer emulsion.

17. A method according to claim 10, wherein said aqueous polyurethane emulsion contains a blocked isocyanate group, and has anionic and/or cationic hydrophilic site.

* * * * *